US006345821B1

(12) United States Patent
Labrot

(10) Patent No.: US 6,345,821 B1
(45) Date of Patent: Feb. 12, 2002

(54) HOUSEHOLD CHORE DESIGNATION GAME

(76) Inventor: Karen L. Labrot, 406 Lion St., #2, Ojai, CA (US) 93023

( * ) Notice: Subject to any disclaimer, the term of this patent is extended or adjusted under 35 U.S.C. 154(b) by 0 days.

(21) Appl. No.: 09/504,388

(22) Filed: Feb. 15, 2000

(51) Int. Cl.[7] ..... A63F 9/00

(52) U.S. Cl. ..... 273/236; 273/240; 273/141 R; 273/440; 273/459; 434/236; 434/238; 434/107; 434/108; 434/109

(58) Field of Search ..... 273/459, 440, 273/148 R, 142 R, 141 R, 236, 240; 434/236, 238, 107, 108, 109

(56) References Cited

U.S. PATENT DOCUMENTS

| | | | | | |
|---|---|---|---|---|---|
| 2,883,765 | A | | 4/1959 | Blaine | 35/23 |
| 3,290,796 | A | | 12/1966 | Gurda | 35/23 |
| 4,327,919 | A | | 5/1982 | Vennor | 273/236 |
| 4,834,657 | A | * | 5/1989 | Gonzalez et al. | 434/238 |
| 5,338,202 | A | | 8/1994 | Saari | 434/127 |
| 5,429,373 | A | * | 7/1995 | Chelko | 273/440 |
| 5,573,404 | A | | 11/1996 | Stawski, II | 434/238 |
| 5,577,915 | A | | 11/1996 | Feldman | 434/238 |
| 5,639,242 | A | | 6/1997 | Wilson | 434/238 |
| 5,657,989 | A | | 8/1997 | Acoba | 273/249 |
| 5,725,381 | A | | 3/1998 | Kollath et al. | 434/238 |
| 6,260,845 | B1 | * | 7/2001 | MacGowan, III | 273/148 R |

OTHER PUBLICATIONS

"Good For Me Reward Kit", Toys To Grow On catalog, p. 23, Feb. 1993.*

"Homework Helper Kit", Toys To Grow On catalog, p. 36, Feb. 1993.*

* cited by examiner

*Primary Examiner*—Benjamin H. Layno
(74) *Attorney, Agent, or Firm*—Kenneth J. Hovet

(57) ABSTRACT

A game for designating chores is provided comprising a board structure having a front face from which markings can be erased. Defined areas of the face are divided into at least a chore region and a name region. Numbered chores are listed in the chore region. Game participant's names are associated with a particular chore by the random selection of game pieces. Each of the game pieces have a different chore number. Playing the game involves spinning a pointer on a spinning number card imprinted with chore numbers or rolling dice having cube surfaces that display chore numbers or randomly selecting one piece from a set of balls, chips, coins or pieces of paper which have been imprinted with chore numbers. The chore number on the selected piece is then assigned to the participant who selected it and that person must complete the chore within the prescribed time period. The board base may include a choice region within which are listed rewards. Upon satisfactory completion of the assigned chore, the participant can chose which reward he/she wishes to receive. The board face may also include a photographic display region, pin-up area, title and note regions. Replaceable pads of paper may be used in place of board markings and storage devices attachable to the board can be used to stow one or more game pieces and implements.

24 Claims, 5 Drawing Sheets

HOUSEHOLD CHORE DESIGNATION GAME

BACKGROUND OF INVENTION

1. Field of the Invention

The present invention relates to a process and device for randomly assigning tasks or chores in a game like setting and can also provide a reward system for successful completion of the assigned task or chore.

2. Description of Related Art

In any relationship where a person in authority must assign tasks or chores, friction can arise based on the assignment of the various tasks or chores. This problem most often occurs in a parent/child relationship, but can also occur in other relationships such as the employer/employee relationship. In the parent/child relationship, certain chores can be perceived by children as easier to complete or more desirable for a variety of other reasons. Based on the assignment of chores, the children can become envious, interpreting assignment of an easier or more desirable chore as favoritism. This results in conflict between the various children and conflict between the parent and the child. To overcome this difficulty, it is desirable to provide a process and device that randomly assigns various chores to the children thereby removing any perception of favoritism.

To a child, the assignment and completion of chores also represents one of the child's least preferred activities. Often for children, an undesirable activity can be made more desirable by presenting the activity in a the form of a game. Accordingly, it is desirable to provide a process or device that assigns chores or tasks in a game like setting.

Often times a child requires additional motivation to compel completion of an assigned chore. For children, motivation often takes the form of threatened punishment if the task is not completed, such as grounding or the removal of certain privileges. In many instances, motivation on the form of threatened punishment is not effective and results in a negative connotation to the assigned chore. Motivation in the form of reward can often be more effective to motivate the child to complete the chore, resulting in a positive connotation assigned to the task. Accordingly it is desirable to provide a device that not only randomly assigns a chore but also attaches a reward for completion of the particular chore.

A variety of devices have been developed relating to children's chores as well as providing rewards for completion of chores. U.S. Pat. No. 5,573,404 discloses a device and process for displaying and tracking positive or negative activities of a child during a stated period and assigning positive or negative monetary value to the activities. This process and device does not, however, provide a means to randomly assign various tasks and does not present a game type environment.

U.S. Pat. No. 3,290,796, discloses a device for allowing a payment for completion of a series of tasks. A coin is inserted at the top of the device and the completion of each of a series of tasks allows the coin to drop toward the bottom of the device. Upon completion of the final task, the coin can be accessed as a reward. U.S. Pat. No. 5,577,915 discloses a device that organizes chores into various categories, tracks completion of the chores and finally, provides a reward system for completion of the chores. U.S. Pat. No. 5,657,989, discloses a device where the participant moves a game piece along a game board a number of spaces corresponding to the number of chores completed, the ultimate goal is to reach "payday". U.S. Pat. No. 5,725,381 discloses a device for listing the a schedule of activities and the corresponding play money reward for completion. The device also has a list of rewards that can be purchased with the play money. All of these processes and devices fail to provide a means for randomly assigning the chores and focus primarily on reward for completion of a series of chores.

U.S. Pat. No. 5,657,989 discloses an "addicted to sevens" game where the winner picks from cards of chores or prizes, all losers of the game to split the costs and chores among themselves. This invention, however, does not provide for the assignment of a defined list of chores and does not provide a reward mechanism for completion of the chore.

SUMMARY OF THE INVENTION

The present invention discloses a process and device for randomly assigning a list of tasks or chores in a game-like setting and for optionally assigning a reward for completion of the task or chore. The reward may comprise an amount of real money, a gift, a favor from a family member, an exemption from an unwanted activity, designation of predetermined quality time with parent(s) and/or family, desired family outings, games and related family fun activities.

More particularly, the present invention is a board that can be mounted in various locations such as on a wall or refrigerator. As used herein, the word "board" is intended to encompass an overall base structure of wood, wood composite, wood/plastic laminate, paper, large pad of paper, plastic, composite resin laminate, chalk board, slate and metal.

The board has a front and a back, the front being divided into a plurality of regions and the back having a means for attaching the invention to a wall or refrigerator. In one of the plurality of regions, a recordation means such as a pen, pencil, marker, crayon or chalk, is used to list the chores to be completed along with a number which is assigned to each chore. If desired, a reward can also be assigned and listed in relation to a chore, the reward earned upon completion of the chore.

The present invention also includes random selection means comprising one or more game pieces for randomly assigning a number to a participant including dice, numbered balls, coins, chips, paper pieces or a spinning number card. Using dice for instance, the participant rolls the dice and when the dice come to rest, the number of the dice is assigned to the participant. The dice number assigned to the participant corresponds to one of the numbers assigned to the listed chore. The chore with the matching number is assigned to the participant. The plurality of regions also includes a region for writing the name of the participant next to the chore randomly assigned to the participant.

The plurality of regions can include regions for adding other features to the invention. A note region may be included to write notes or to keep a tally of the rewards earned by the participants. Additional regions comprise a photograph holding area for mounting and displaying photographs and other two dimensional works, a cork region for posting notes or photographs using tacks or pins and a title region for identifying the tasks being completed and/or the time frame for completing the tasks.

The present invention also provides a storage means comprising a container for stowing operational game parts such as the game pieces, pens, markers, erasers, and board wiping cloths. The storage means may also comprise constraining devices such as magnetic, Velcro and adhesive strips, sleeves, bags, brackets, clamps or other mechanical devices which are adapted to releasably constrain the above items and hold them on, or adjacent to, the board.

DESCRIPTION OF THE PREFERRED EMBODIMENTS

Figure 1:
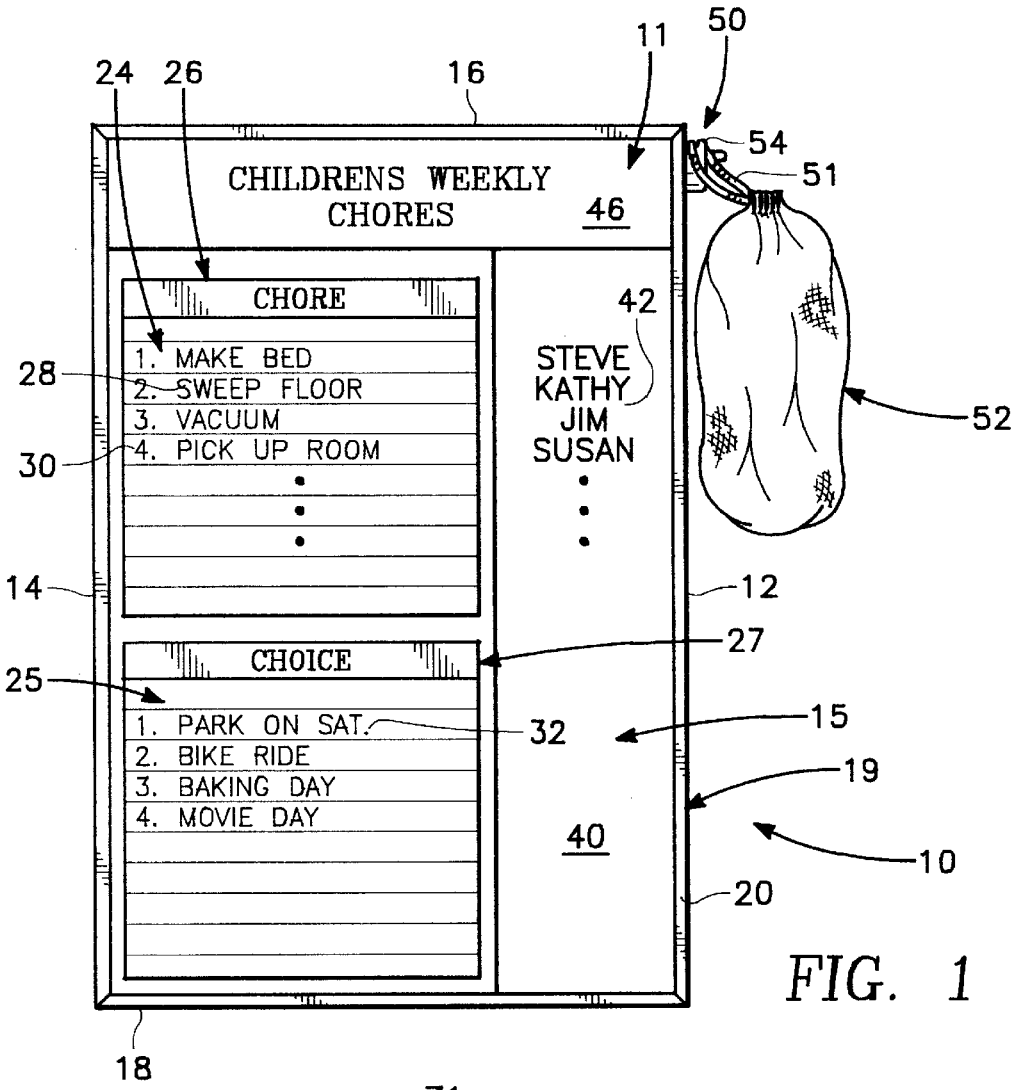
FIG. 1 is a plan view of one of the embodiments of the invention showing the various regions and a storage pouch.

With reference now to the drawings, one of the preferred embodiments of the invention is shown in FIG. 1, and is referenced generally by numeral 10. The invention comprises a board 11 which can have a round, oval or polygonal outline. In the preferred embodiment, the board has a rectangular outline defined by a right edge 12, a left edge 14, a top edge 16, a bottom edge 18, a front 15 and a back 17. Preferably, the board has a uniform thickness throughout.

Figure 8:
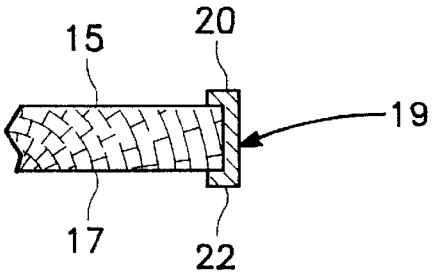
FIG. 8 is a enlarged fragmentary cross-sectional view taken along circular line 8—8 of FIG. 2.

The overall board 11 can be made of suitable rigid materials as described above. In the preferred embodiments, the board is made of a wood composite with a plastic dry erasable front surface layer. The front 15 is divided into a plurality of regions to provide a display means for the game. The back 17 generally provides a means for mounting the invention 10. As an alternative embodiment, the perimeter 19 of the board is framed with a front rim 20 and rear rim 22 as shown in FIG. 8. With this construction, the perimeter 19 will have a greater width than the interior areas.

One of the plurality of regions on the front 15 of the board includes a chore region 24 providing a location for listing the tasks or chores to be completed. The tasks may be written directly on the board encompassed by the chore region. Alternatively, the chore region 24 may contain a pad of discarbable sheets of paper 26 upon which the chores can be listed. So that the pad can be replaced, it should be provided with attachment means such as magnetic strips, Velcro strips, adhesive, clips, hook, pins and other means known in the art.

After listing the chores to be completed, chore numbers 30 are then sequentially assigned to each chore 28, the first chore usually assigned number one. When complete, the pad will contain the desired list of chores with a different number assigned to each chore.

In the same manner as above, board 11 includes a choice region 25. The choice region provides a location for listing chore rewards 32. A reward can be chosen by a game participant or it can be assigned preliminarily to each chore. The rewards may be written on the board in the choice region or below the chore area on the same pad 26 under the heading "Choice". Alternatively, a separate pad 27 can be used as shown in FIG. 1. The chore reward 32 is earned upon completion of a chore.

At another of the plurality of regions, the board includes a name region 40 for listing the name of the game participants 42 as such participants are randomly assigned to a task by a random selection means. The participant's name 42 is written in the name region 40 next to the chore in the chore region as that chore is assigned to a participant. This provides an easy to read and understandable display of the assigned task. The name region 40 includes a plastic, metal or synthetic resin overlay throughout, of a type that can tolerate writing from a dry-erase marker so that a simple cloth, felt pad or the like may be used to remove the writing.

Above the chore region 24 and the name region 40, is a title region 46. The title region can be used to identify the class of game participants, such as by family, name, age, social or business group and the time frame for completing the tasks. As shown, the title region 46 identifies the class as "children" and time frame as "weekly". The title region 46 is similar to the name region in construction and so that it can be wiped clean and reused.

For convenience, at least some of the operational game parts of the invention may be stowed in a container which can be releasibly attached to the board. Alternatively, one or more of the game parts may be releasably attached via the previously described constraining devices.

Figure 2:
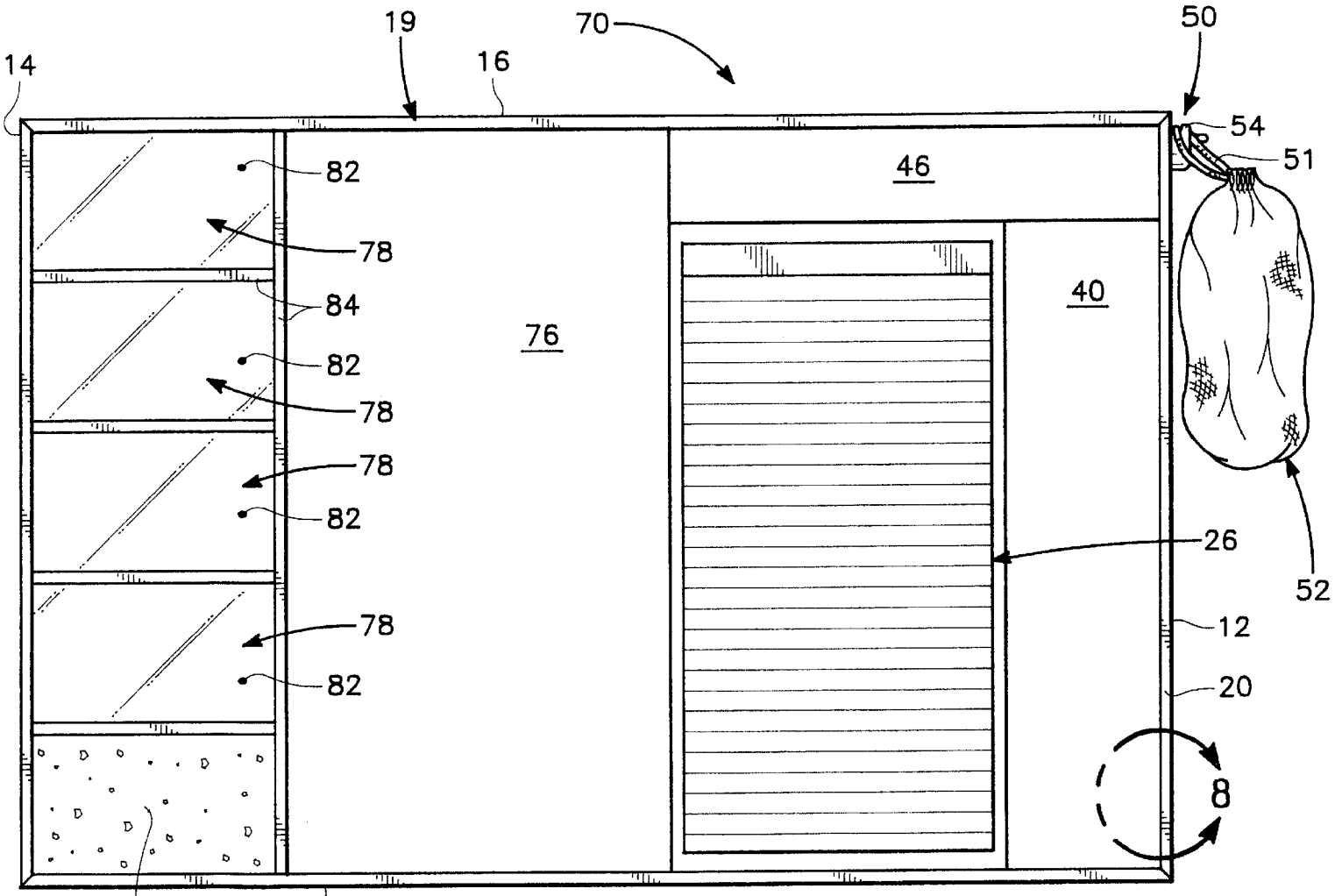
FIG. 2 is a plan view of a second embodiment of the invention showing additional regions.
Figure 3:
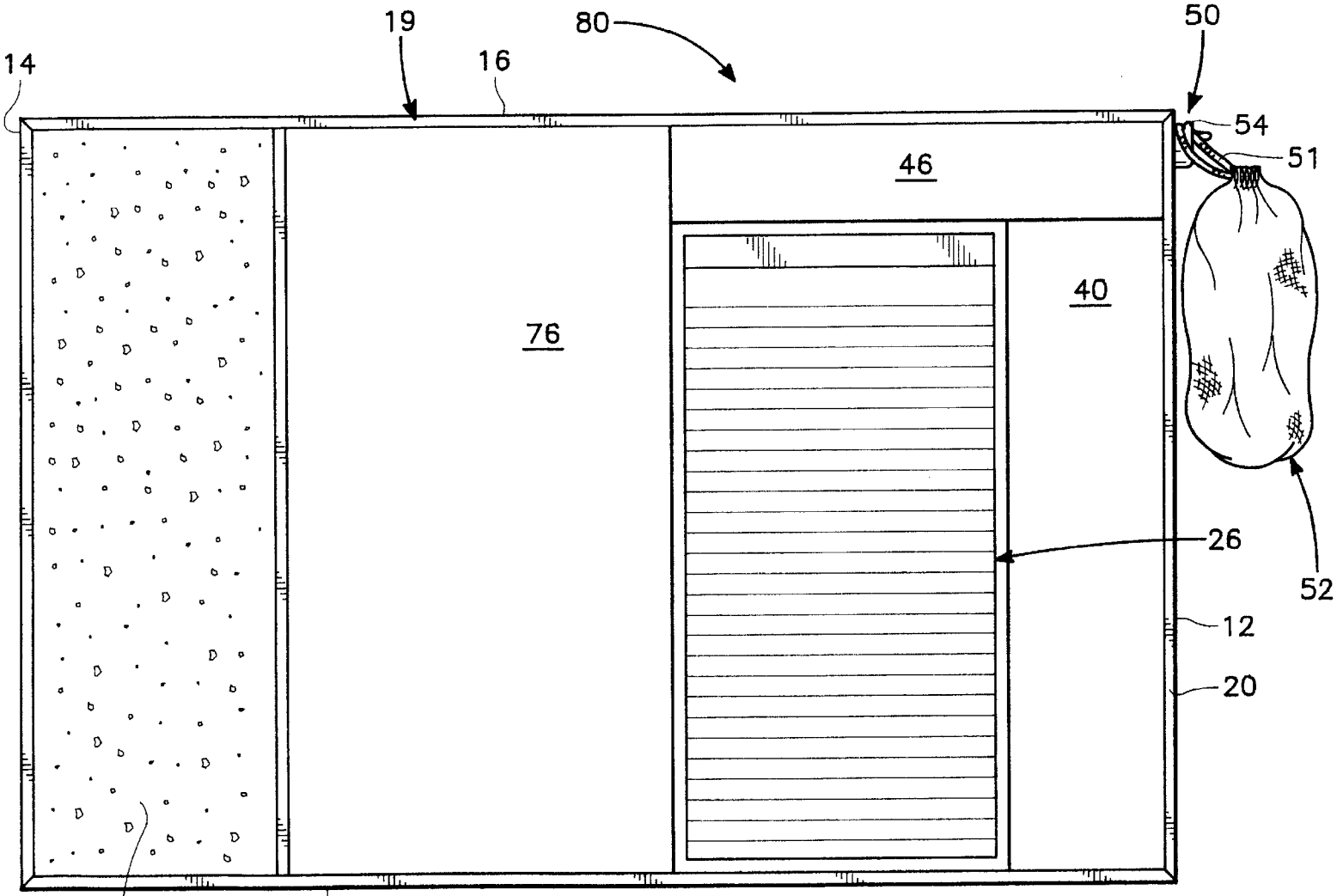
FIG. 3 is a plan view of a third embodiment of the invention showing a alternate leftmost region.

An example of a container that may be used in the above manner is illustrated in FIGS. 1–3. There, a storage pouch 52 is shown hanging by its drawstrings 51 from pouch hook 50. The pouch hook 50 is affixed to the raised outer edge 19 of the board perimeter so that it will not interfere with mounting the board upon a door or wall.

Figure 5:
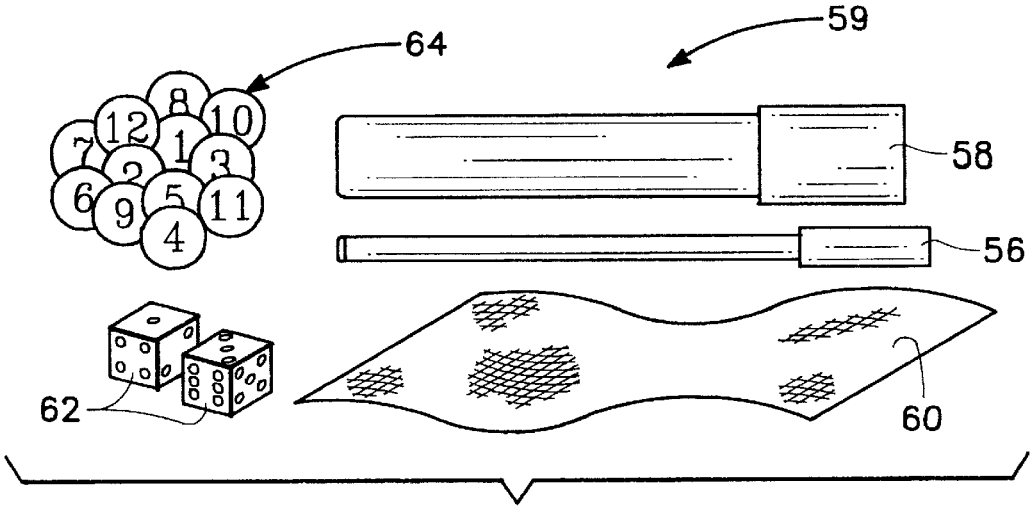
FIG. 5 shows examples of game pieces and related items that can be stowed in the storage means.

Some of the game parts 59 may be stowed in the pouch 52 while other bulkier game parts may be attached to the board by the aforementioned constraining means. FIG. 5 illustrates a chore pen 56 for writing the chores on pad 26, an erasable marker 58, an erasing cloth 60, dice 62 and numbered balls 64. Each of the above items are amenable to placement in pouch 52. Optionally, the dice pieces may be held together in an elastic sleeve which can then be placed in the pouch or be attached separately by the constraining means to the board.

The novel nature of the present inventive process and device is best appreciated in operation of the embodiments of the invention. As outlined above, the chores 28 to be completed are listed in the chore region 24 on the paper pad 26 and a chore number 30 is also assigned to each chore and written next to the chore on the pad. At that time, a corresponding chore reward 30 can also be assigned to the chore. The reward is written in the lower portion of pad 26 under "Choice" or on the board surface in the choice region. Alternatively, the rewards may be listed on a separate pad which is either releasably attached to board 11 or located elsewhere. The title for the chores and the completion time period can be written in the title region 46 with the cloth erasable marker 58.

When the list is complete, the participants choose a method for randomly assigning a chore to a participant. One method includes removing the dice 62 from the storage means shown as pouch 52 and rolling the dice on to a horizontal surface. When the dice come to rest, the number showing on the dice will correspond to a chore having the same number. That chore will then be assigned to the participant who took the chance and rolled the dice. As used herein, the term "dice" means one or more dice cubes with at least some of the cube faces displaying a different chore number or a representation thereof.

A second method of randomly assigning a chore to a participant includes the use of numbered balls 64, each of the numbered balls having a different chore number. In this method, the numbered balls can remain in the support pouch 52 and the participant blindly reaches into the storage pouch choosing one of the numbered balls. The number on the chosen ball will correspond to a chore and that chore will thereby be assigned to the participant. In place of the above balls, pieces of paper, chips or coins displaying chore numbers could also be used.

Figure 7:
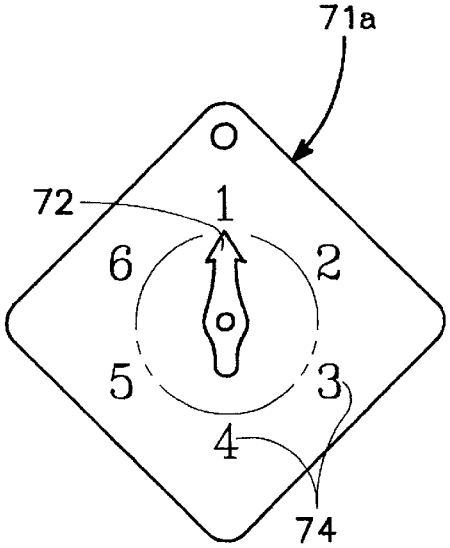
FIG. 7 shows the spinning number card as a non-mounted separate device, optionally stowed in the storage means.

A third method of randomly assigning a chore utilizes a spinning number card 71*a* as shown in FIG. 7. The card includes a base displaying a circular dial of different chore numbers spaced radially from a locus. The participant spins a pointer 72 which is rotationally attached to the base at the locus. When the pointer stops, it will point to a card chore number 74. The card chore number corresponds to a chore which is then assigned to the participant. The name of the participant is written in the name region 40 next to the chore which has been assigned to the participant. This process is continued until all game participants have been assigned a chore or until all the chores have been assigned.

If the same chores 28 need to be assigned a second time, the names of the participants 42 can be erased with the erasing cloth 60 and the chores randomly assigned again. If a new list of chores needs to be created, the top piece of paper on the paper pad 26 can be removed and discarded, revealing the next sheet on the pad. The new chores can then be listed on the next sheet. This can be done when the tasks are complete or at the end of a selected time period such as a day or a week. When all sheets of the pad are consumed, one or more new lined pads can be mounted in place of the consumed pad.

A second embodiment 70 of the invention, shown in FIG. 2, includes additional regions beyond those disclosed in FIG. 1. One additional region is a note region 76 for writing notes or keeping a tally of the chore rewards 32 given for completion of a chore 28. For instance, the status of chore rewards for a participant can be tracked and recorded on the note region 76 through a predetermined span of time, such as a week or a month. As a chore is completed, the chore reward 32 can be recorded in the note region. At the end of the specified time period, the chore rewards 32 can then be given. The note region may have a construction similar to the name region and title region so that it will tolerate writing from a marker and erasing with a cloth or similar implement.

The embodiment shown in FIG. 2 also includes a plurality of photograph display regions 78. As used herein, the term "photograph" is intended to include two dimensional works such as pictures, sketches, drawings, printed materials and artwork. Each of the photograph display regions has a raised boundary 84. A thin transparent material 82, such as a plastic or glass plate is provided that fits snugly within the raised boundaries.

To display the photographs, the thin transparent material is removed from selected photograph display regions and photographs the same size or smaller than the display region are placed behind the transparent material. Both the photograph and the transparent material are thereby mounted for display of the photograph.

The embodiment shown in FIG. 2 also includes a small cork region 86 used for attachment of drawings, photographs, messages, etc. The small cork region also has raised boundaries 84 and includes a cushion inlay, such as cork or fiber board material, which will be suitable for insertion with various types of common tacks and push-pins. A drawing, message or photograph can be displayed from the cork region by affixing the note, message or photograph to the inlay material with a tack or pushpin.

A third embodiment 80, shown in FIG. 3, discloses a large cork region 88 which replaces the plurality of photograph display regions and the small cork region. The large cork region 88 is used to display notes, messages and photographs in the same way as the small cork region. Other regions with varying functions could be added or defined within the board outline to provide additional display and game features.

Figure 4:
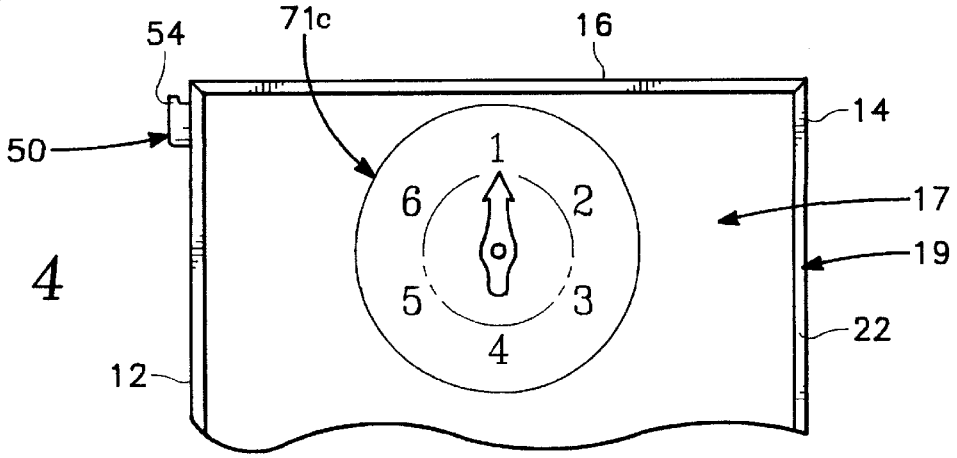
FIG. 4 is a plan view of the back of the preferred embodiment showing a mounted spinning number card.
Figure 6:
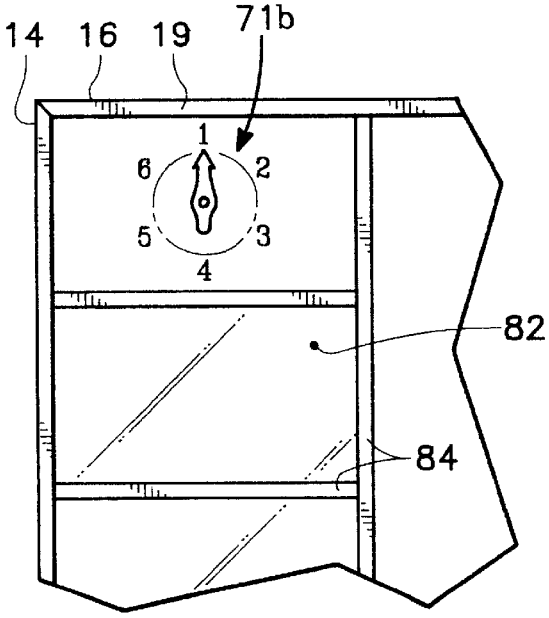
FIG. 6 is a cutout of the front upper leftmost region of the board showing the spinning number card as an integrated part of the board.

FIGS. 4 and 6 show additional embodiments of the invention relating to the spinning number card 71*a*. In the embodiment shown in FIG. 6, the chore numbers for an integrated spinner card 71*b* are imprinted in a region previously dedicated to the photograph display region. The numbers are imprinted in a circle about a locus directly on board 11 and the spinner is pivotally fastened to the locus point. Alternatively, as shown in FIG. 4, the chore numbers for an integrated rear spinner number card 71*c* can be imprinted on the back of board 11 in a manner similar to board 71*b*. Finally, as depicted in FIG. 7, the spinning number card 71*a* can be separate from board 11 and stowed in the storage pouch 52 when not in use. In each one of the above embodiments, the spinning number card 71*a*, 71*b*, 71*c* is utilized as previously described.

Figure 9:
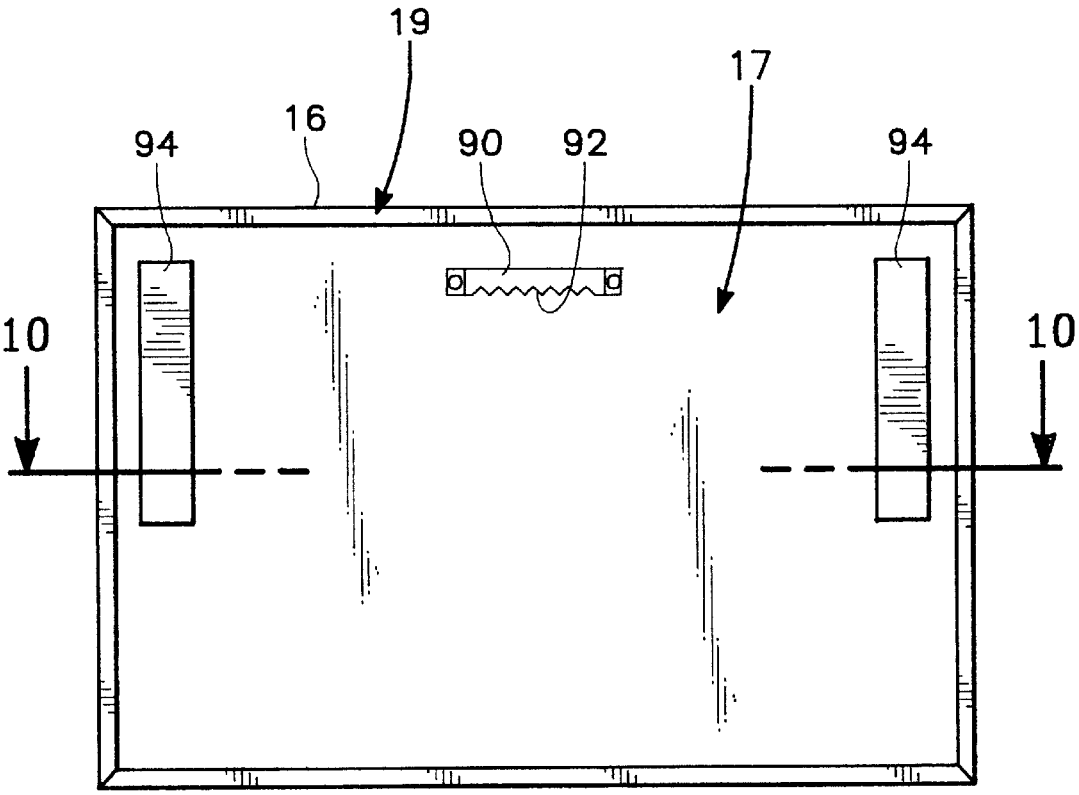
FIG. 9 is a plan view of the back of the present invention showing alternative methods for mounting the board on a wall or refrigerator.
Figure 10:
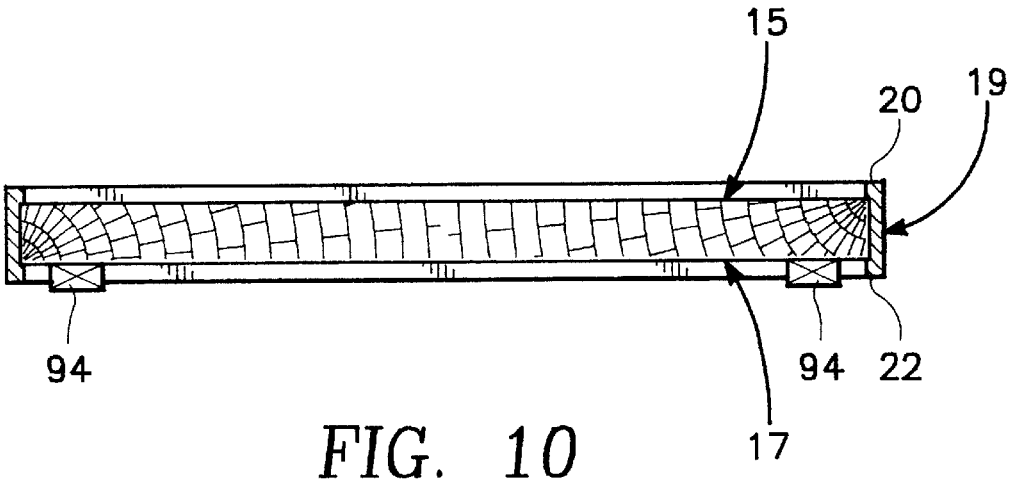
FIG. 10 is a cross-sectional view taken along lines 10—10 of FIG. 9.

FIGS. 9 and 10 show the back 17 of any of the disclosed embodiments of the invention, illustrating two methods for mounting the overall board 11 to a support structure, e.g., a door or wall. A serrated mounting bracket 90 is secured to the upper portion of back 17 proximate the vertical median line. The mounting bracket 90 is compatible with a nail or screw that has been fastened to a wall. The saw tooth edge 92 of the mounting bracket 90 rests on the nail or screw, suspending the board by gravity.

Alternatively, board 11 can be secured to a metal surface by engagement with mounting magnets which are fastened to back 17 of the board. As shown, two mounting magnets 94 are spaced-apart with one magnet mounted near right edge 12 and the other near left edge 14. For balance, the magnets are equal distance from the vertical median line of the board. It will be appreciated that other mounting means can be used such as Velcro, adhesives and brackets as dictated by the support structure characteristics.

While the invention has been described with respect to preferred embodiments, it will be clear to those in the art that modifications and improvements may be made to the invention without departing from the spirit and scope of the invention. Therefore, the invention is not to be limited by the specific illustrative embodiments, but only by the scope of the appended claims.

I claim:

1. A chore/reward game assembly for randomly assigning chores to a participant in a game-like setting comprising:

a board;

display areas on said board within which are listed a plurality of chores to be completed; and, a random selection means associated with said display areas for assigning said plurality of chores to a participant.

2. A chore/reward game assembly for randomly assigning a chore to a game participant comprising:

a board;

defined regions on said board within which are listed chores and a corresponding chore number; and, a random selection means for assigning a random number to a participant, said random number matching one of said chore numbers which corresponds to a listed chore.

3. The assembly of claim 2 wherein said board comprises a sheet of material having a front divided into a plurality of said regions, said regions comprising:

a chore region within which are listed chores and a corresponding chore number;

a name region within which are listed the names of participants assigned to a selected chore; and, a choice region within which are listed rewards to be achieved upon completion of a selected chore.

4. The assembly of claim 3 wherein said regions include a title region within which is described the overall type of chores listed in the chore region and the time period for completing the chores.

5. The assembly of claim 4, wherein said name region and said title region have a surface comprising an overlay from which markings can be erased.

6. The assembly of claim 3 wherein said regions include a note region within which is described a participant's progress on completing chores.

7. The assembly of claim 6 wherein said regions include a photograph display region.

8. The assembly of claim 7 wherein said regions include a cork region having a cushion inlay for releasable attachment of photograph materials, notes and messages.

9. The assembly of claim 3 wherein said random selection means comprises at least one dice cube having display surfaces with different chore numbers or number representations on at least some of said display surfaces.

10. The assembly of claim 3 wherein said random selection means comprises a plurality of a member selected from the group consisting of ball, paper pieces, chips and coins, each displaying a number that corresponds to a chore number.

11. The assembly of claim 3 wherein said random selection means comprises:

a spinning number card having a base with a plurality of card numbers that correspond to said chore numbers imprinted in a circle about a locus on said base; and, a pointer rotationally attached to said base at said locus.

12. The assembly of claim 11 wherein the base of said spinning number card is mounted on the front of said board.

13. The assembly of claim 2 including a recordation means for listing said names, chores and rewards comprising a member selected from the group consisting of pen, pencil, felt marker, crayon and chalk, said random selection means comprising game pieces.

14. The assembly of claim 13 wherein said game pieces comprise a member selected from the group consisting of dice, balls, chips, coins or paper pieces and a spinning number card each of which display a different chore number.

15. The assembly of claim 14 wherein said chore and choice regions include at least one pad of paper sheets.

16. The assembly of claim 13 including operational game parts and a storage means comprising a container or constraining device for releasably holding one or more of said operational game parts.

17. A method for randomly assigning chores to a game participant comprising the steps of:

providing a list of chores to be completed;

assigning a different chore number to each chore;

providing one or more game pieces with a different one of said chore numbers on each game piece;

randomly selecting a numbered game piece by the game participant; and, assigning the game participant who selected the numbered game piece the chore associated with the selected game piece number.

18. The method of claim 17 including the steps of:

providing a board having a front surface; and, segmenting defined areas of said surface into a chore region and a name region.

19. The method of claim 18 including the steps of:

locating said list of chores in said chore region;

providing a list of game participant's names; and, locating said list in said name region.

20. The method of claim 19 including the steps of:

segmenting a defined area of said front surface into a choice region; and, providing a list of rewards to be achieved when a game participant completes the assigned chore; and, locating said list of rewards in said choice region.

21. The method of claim 18 including the steps of:

segmenting a defined area of said front surface into a title region and a note region;

providing a description of the class of game participants and the time period for chore completion;

locating said description in said title region; and, providing a status listing of chore work progress; and, locating said status listing in said note region.

22. The method of claim 17 wherein said numbered game piece comprises at least one dice cube and wherein the step of randomly selecting a numbered game piece comprises:

rolling the dice cube by a game participant;

after the cube come to rest, noting the chore number showing or the sum of the numbers showing if more than one dice cube is rolled; and, assigning the noted chore number and corresponding chore to the game participant.

23. The method of claim 17 wherein said numbered game piece comprises a spinning number card having a base with different chore numbers imprinted in a circle about a locus with a pointer pivotally attached to said base at said locus, wherein the step of randomly selecting a numbered game piece comprises:

spinning said pointer by a game participant;

when the pointer stops spinning, noting the chore number most closely aligned with the pointer; and, assigning the noted chore number and corresponding chore to the game participant.

24. The method of claim 17 wherein said game piece comprises a set of members selected from the group consisting of balls, coins, chips or pieces of papers, wherein the step of randomly selecting a game piece comprises:

choosing a set with which to play;

randomly mixing the members of said set;

blindly selecting one member from the set by a game participant;

noting the chore number on the member; and, assigning the noted chore number and corresponding chore to the game participant.

* * * * *